US006648630B2

(12) United States Patent
Tse

(10) Patent No.: US 6,648,630 B2
(45) Date of Patent: Nov. 18, 2003

(54) GAS IGNITER WITH FLEXIBLE EXTENSION

(76) Inventor: Robert W. Tse, 19417 E. Windrose Dr., Rowland Hts., CA (US) 91748

( * ) Notice: Subject to any disclaimer, the term of this patent is extended or adjusted under 35 U.S.C. 154(b) by 0 days.

(21) Appl. No.: 10/057,871

(22) Filed: Jan. 25, 2002

(65) Prior Publication Data

US 2002/0094500 A1 Jul. 18, 2002

Related U.S. Application Data

(63) Continuation-in-part of application No. 09/728,915, filed on Nov. 30, 2000, now abandoned.

(51) Int. Cl.[7] ..... F23D 11/36; F23D 14/46; F23D 14/48; F23Q 7/12

(52) U.S. Cl. ..... 431/153; 431/344; 431/345; 431/255

(58) Field of Search ..... 222/527, 530, 222/538; 431/345, 344, 153, 255; 126/405, 406, 407; 239/DIG. 12, 588; D26/8; D27/141, 161, 139; D7/416

(56) References Cited

U.S. PATENT DOCUMENTS

| | | | | | |
|---|---|---|---|---|---|
| 2,203,210 | A | * | 6/1940 | Young | |
| 3,674,413 | A | * | 7/1972 | Fraser | 431/344 |
| D241,645 | S | * | 9/1976 | Lanzi | D7/416 |
| 4,318,403 | A | * | 3/1982 | Sneider | 604/2 |
| D277,307 | S | * | 1/1985 | Zeller et al. | D7/416 |
| 4,538,983 | A | * | 9/1985 | Zeller et al. | 431/255 |
| 4,650,100 | A | * | 3/1987 | Echazabal, Jr. | 222/475 |
| 4,738,242 | A | * | 4/1988 | Hart | 126/271.1 |
| 4,810,173 | A | * | 3/1989 | Thomson et al. | 417/411 |
| 5,108,016 | A | * | 4/1992 | Waring | 222/468 |
| 5,154,483 | A | * | 10/1992 | Zeller | 362/198 |
| 5,199,865 | A | * | 4/1993 | Liang | 431/255 |
| D337,839 | S | * | 7/1993 | Zeller | D26/43 |
| 5,369,556 | A | * | 11/1994 | Zeller | 431/344 |
| D362,313 | S | * | 9/1995 | Zeller | D26/43 |
| 5,460,520 | A | * | 10/1995 | Lin | 431/255 |
| 5,460,521 | A | * | 10/1995 | Tsai | |
| 5,597,097 | A | * | 1/1997 | Morris | 222/529 |
| D382,441 | S | * | 8/1997 | Ferrara, Jr. | D7/416 |
| 5,697,775 | A | * | 12/1997 | Saito et al. | 431/153 |
| 5,738,507 | A | * | 4/1998 | Mifune et al. | |
| D441,606 | S | * | 5/2001 | Tubby et al. | D7/416 |
| D454,277 | S | * | 3/2002 | Chevalier | D7/416 |
| D464,848 | S | * | 10/2002 | Chevalier et al. | D7/416 |

* cited by examiner

*Primary Examiner*—Carl D. Price

(57) ABSTRACT

A gas igniter comprises a casing detachably connected to a container which holds an inserted commercial available disposable gas lighter as fuel source, wherein. providing an easy and inexpensive means of gas refilling, whereby, a user can refill with a commercially available disposable lighter without discarding all the usable parts. A flexible extension that can be freely curved at any angle and retained to the given shape to perform ignition even in a tight spot area A p ay safety switch and a secondary safety switch of the igniter provide extra security to inhibit the children to master an ignition.

4 Claims, 7 Drawing Sheets

GAS IGNITER WITH FLEXIBLE EXTENSION

This is a Continuation-in-Part U.S. patent application Ser. No. 09/728,915, now abandoned filed Nov. 30, 2000

BACKGROUND OF THE INVENTION

The gas igniter on the market today can be categorized into two different types. One is the disposable type which has the advantage of convenient to get and use but after the fuel source is finished, the whole unit has to be thrown away including all the working parts due to the discontinue fuel supply. In the economic view point, that is a disadvantage to the consumer who throw away all the usable parts which they already paid for, and it is less environmental friendly since most of the parts are still in working condition and can be reuse. This type of disposable gas igniter is well known to the consumer today and is disclosed in U.S. Pat. No. 5,738,507.

Another one of the gas igniter is the reliable type that the fuel can be refilled from an outside source. This type of refillable gas igniter is mentioned in U.S. Pat. No. 4,538,983 and U.S. Pat. 5,369,556 that a gas igniter constructed with an opening allow access to a container for fuel refilling. It has the advantage of reusing the working unit again when the fuel is finished, but for the consumer to get the fuel supply for refilling which commonly known as the bottle gas, the price is expensive when compare to a disposable lighter and not many stores carry the bottle gas. Thus it makes it harder to find the fuel source for refill and it became inconvenient to consumer, hence it is a disadvantage to the consumers. Moreover, the engineering construction of the housing in U.S. Pat. No. 4,538,983 and U.S. Pat. 5,369,556 do not provide a means of easy access for alternative gas supply other than using bottle gas for refill.

It would be ideal to provide a gas igniter which is gas refillable and the gas refill source is easy to get and inexpensive in cost. Commercially available disposable lighter is carry by almost every convenient stores, gas stations, supermarkets as well is drug stores and it is very inexpensive. Therefore, by using a disposable lighter as the refill fuel source for the gas igniter, the objective mentioned above is accomplished.

In U.S. Pat. No. 5,460,520, a Palm-top gas torch using a disposable gas lighter for refilling is disclosed. However, this particular type of Palm-top gas torch is not constructed for igniting purpose since the torch unit is design to fit into the user's hand wherein the hand will be too closed to the object in particular when it is used to light material that is highly combustible. Therefore, it is not favorable and not suitable from a safety viewpoint to use this particular type of gas torch for igniting purpose.

Accordingly, it is a principal object of the invention to provide a gas igniter for which the consumer do not throw the whole unit away including all the working parts as like the disposable gas igniter, and as well not like the conventional refillable type gas igniter using the bottle gas which is hard to find and expensive in cost; that can benefit with the convenience of easy to find and inexpensive in cost for the refill fuel supply by using a commercially available disposable gas lighter . With present invention, thus both the advantage of disposable inter and the conventional refillable igniter can be obtained.

BRIEF SUMMARY OF INVENTION

The present invention has been accomplished to provide an orthopedically engineered trigger-controlled igniter that is comfortable and convenient to use. And the present invention further provides an inexpensive as well as easy access of fuel supply for refill by using a commercially available disposable gas lighter The present invention is as well a favorable to the environment that the majority parts of the unit can be reuse again without throwing away all the usable parts, hence it can cut down the waste to the Dual when compared to the conventional disposable gas igniter.

According to one aspect of the present invention the gas igniter comprising a casing detachably connected to the container which hold a disposable lighter as a gas reservoir, a primary safety switch which disposed within the sliding track with locking and unlocking position, a secondary safety switch formed by a push-button and rocking lever, and a trigger are disposed for controlling gas supply from the reservoir, a rubber gas flow connection and a piezo electric unit are incorporated into the casing portion assembly, a hollow flexible member extends from the casing with one end and the opposite end connected to a front pipe, which mounted with flame nozzle that connected with gas pipe and ground electrode.

In order to actuate the igniter, first, slide the primary safety switch to unlock position, then push the push-button of the secondary safety switch upward to move the rocking lever to unlock the trigger, and then pull down the trigger, the trigger controlled to depress the gas lever of the disposable gas lighter and the piezo electric unit simultaneously causing a flame produced at the flame nozzle that shoot out from the flame port of the front pipe, when the user released the trigger after each use. the trigger will recess back to locking position automatically by the piezo electric unit which construct with a build-in spring ,the gas supply is cut off when the gas lever of the disposable lighter is released from the trigger.

Another aspect of the present invention, three elastic members are disposed or the curved side of the igniter provided a comfortable soft grip for the user.

Still another aspect of the invention, the flexible member with a stud which construct on the front pipe can snap into the hole of the elastic member on the casing for easy storage.

BRIEF DESCRIPTION OF THE DRAWINGS

FIG. 1 is a prospect view of the igniter with the flexible member snap on

DETAILED DESCRIPTION OF THE INVENTION

Figure 1:
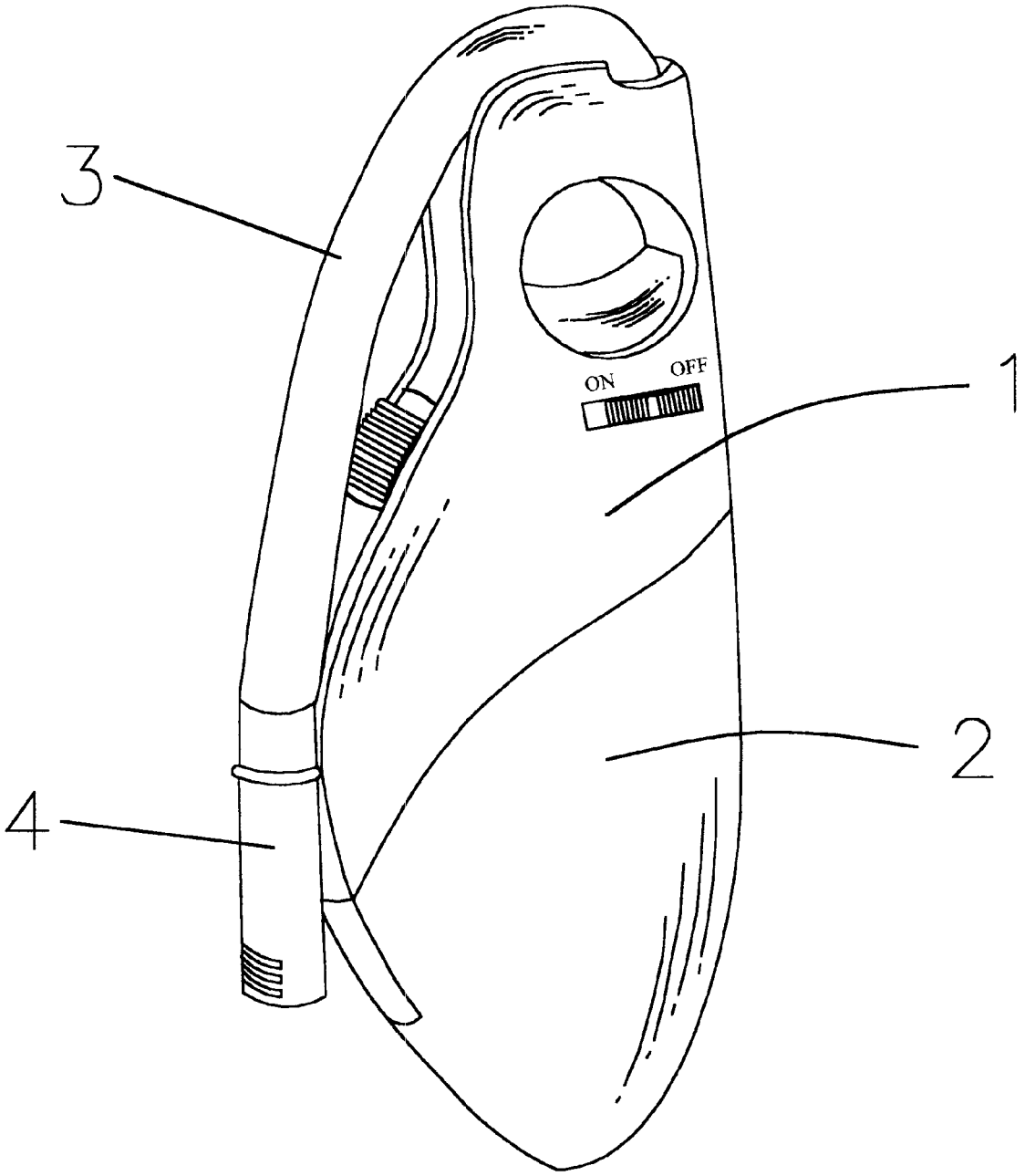

Referring to FIG. 1 a trigger-controlled gas igniter in accordance with present invention is generally comprised of a casing 1 formed by two half, a container 2 detachably connected to the casing 1. A flexible member 3 disposed between the casing 1 and a front pipe 4.

Figure 4:
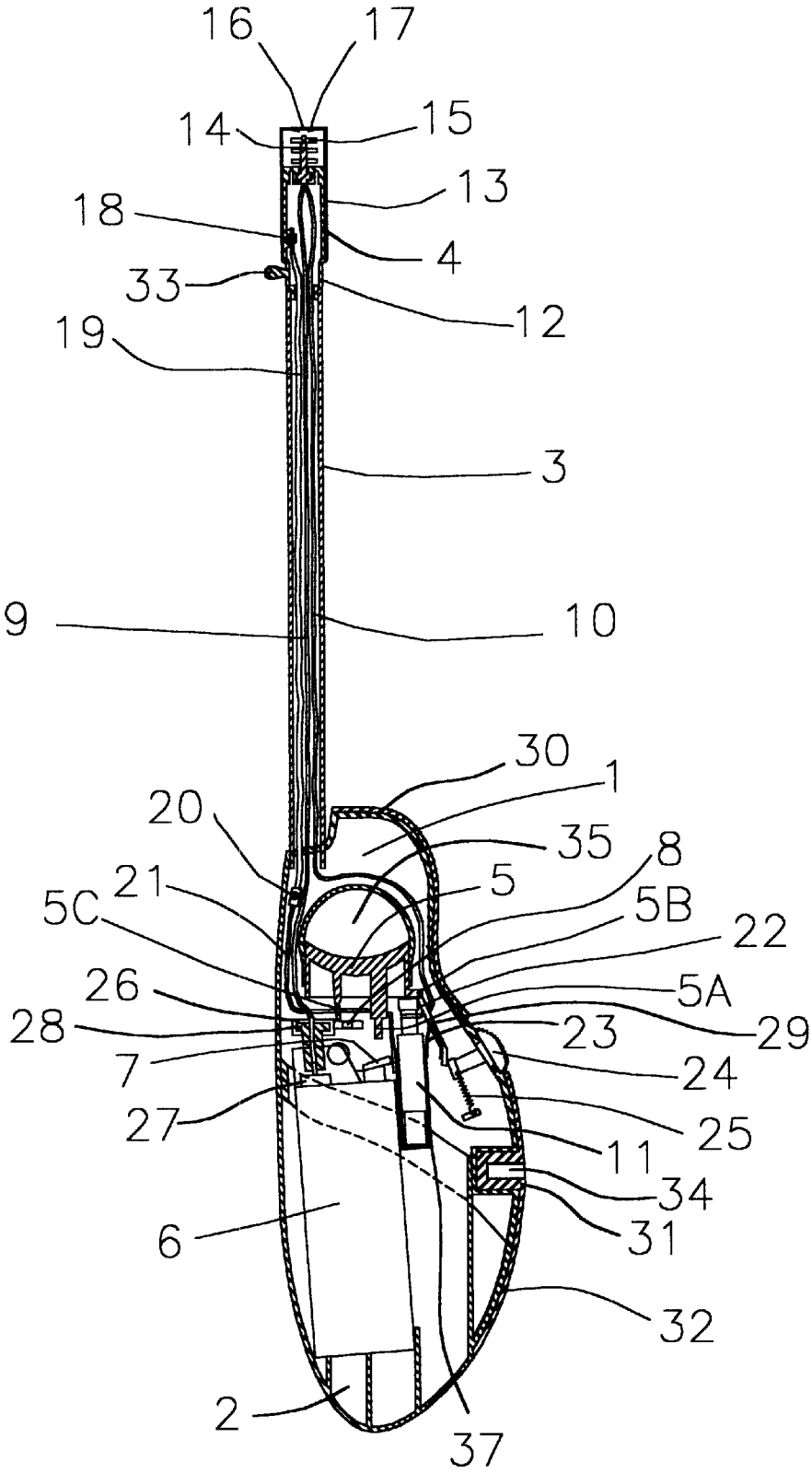
FIG. 4 is a cross-sectioned view of the igniter
Figure 4A:
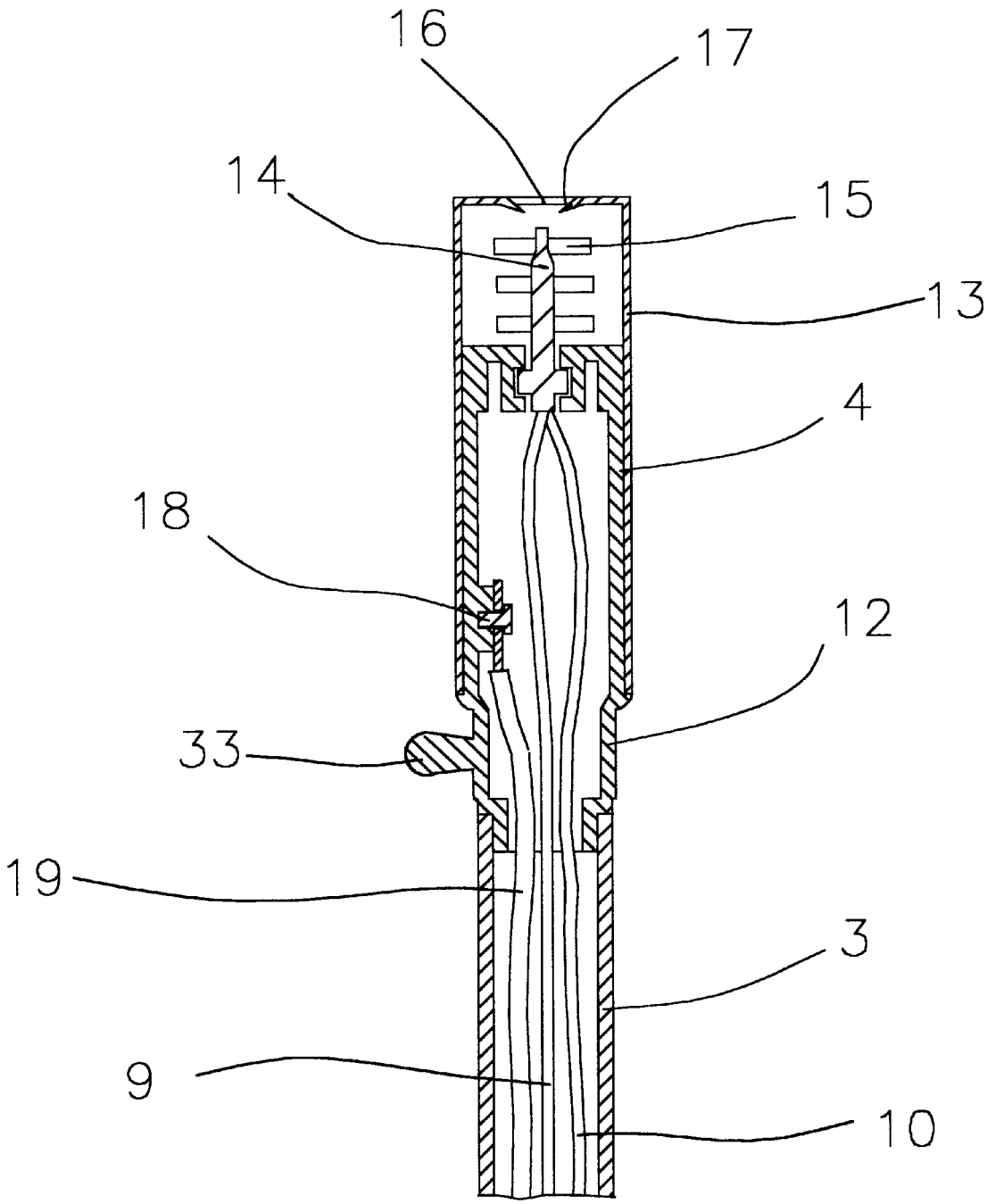
FIG. 4a is an enlarged cross-sectioned view of flexible remember and a front pipe
Figure 4B:
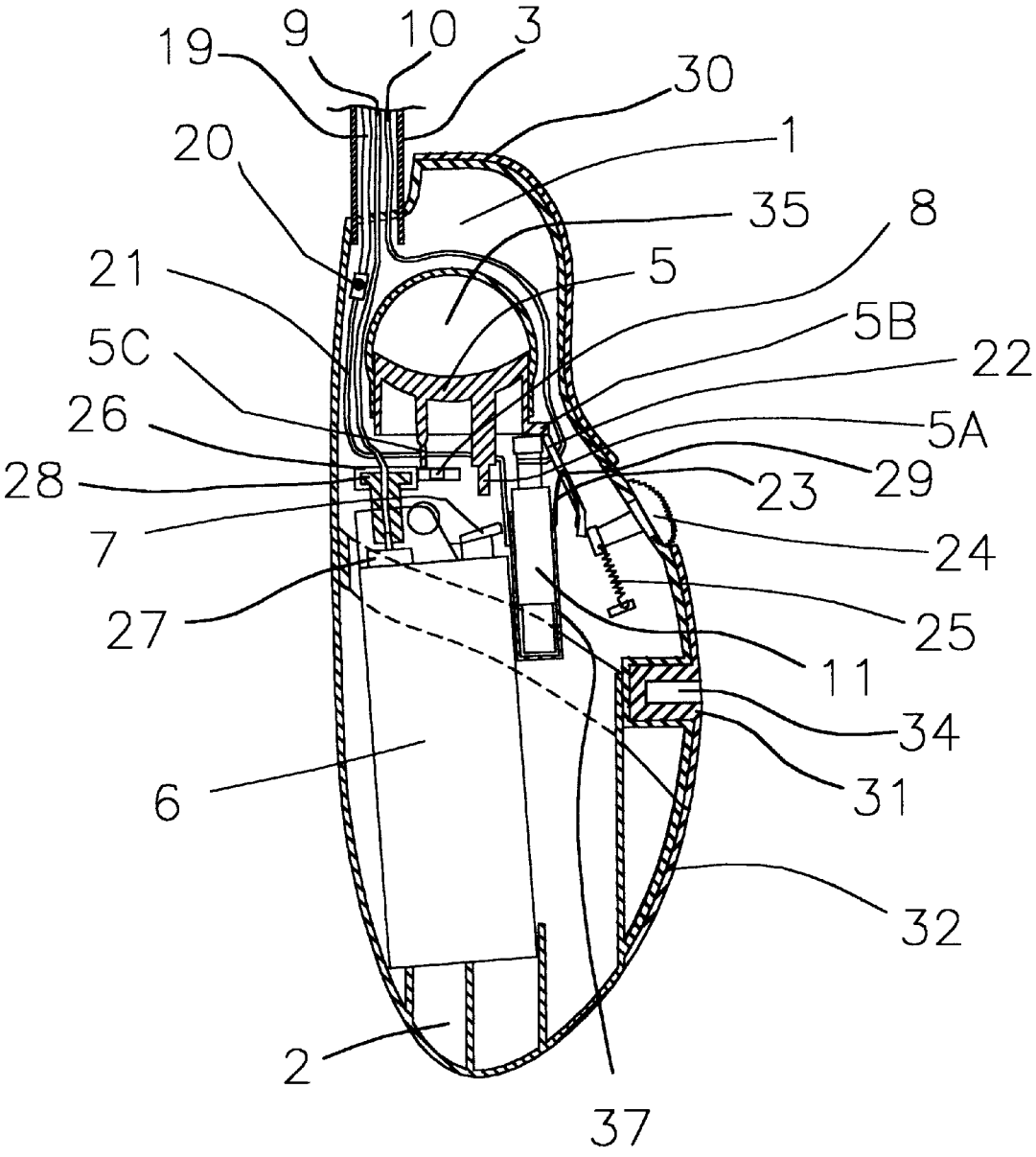
FIG. 4b is an enlarge cross-sectioned view of casing and container

Referring to FIG.4, casing 1 which holds a piezo electric unit 11 that produces discharge for ignition, a primary safety switch 8 and a secondary safety switch which is formed by push-button 24 and rocking arm 22 that provide further security to inhibit the 10 operation thereof by children, an elastic gas flow connector 28 for connecting the fuel supply, a trigger 5 for pressing to carry out the ignition, the container 2 defines a suitable holding space and locating means for holding a disposable lighter 6 inside the holding space, the front pipe comprises a tubular member 13, a cylindrical nozzle holder 12 a flame nozzle 14.The front pipe defines a flame outlet for the ignited gas. Casing 1 and container 2 is connected by the upper part of container 2 inserted into the lower part of casing 1 and secured by a catch( not shown) that can be pulled apart easily for refill by replacing the disposable gas lighter 6 as a cartridge, partition walls 26 are made inside the casing 1 to hold the elastic gas flow connector 28 which one end connected to a fuel a nozzle 27 of the inserted disposable gas lighter 6 and the opposite end connected to the flame nozzle 14 mounted in the front pipe 4 by a flexible gas pipe 9. The piezo electric unit 11 is mounted within a partition 37, electrode 21 of the piezo electric tut 11 is connected with a spine 19 by a screw 20. The spine 19 is formed by one or more strains of metal wire, which can be bent easily and remained a given shape, and it is a conductive material. The spine 19 connected with the electrode 21 at one end and the opposite end connected to the tubular metal member 13 of the front pipe 4 by a screw 18 secured at the cylindrical nozzle holder 12. A ground electrode 10 of the piezo electric unit 11 is connected to the flame nozzle 14. The spine 19, the ground electrode 10 and the flexible gas pipe 9 are disposed interiorly of the hollow flexible member 3. The cylindrical nozzle 12 accommodated the flame nozzlel4 with one end is inserted into the tubular metal member 13, and the other end is inserted to the flexible member 3.Thus the front pipe 4 is connected to casing 1 by the flexible member 3.

The tubular metal member 13 has a front-end wall and a flame port 16 through which flame is injected outward is formed in the central portion of the front-end wall. Air intake ports 15 are formed in the upper side portion of the tubular metal member 13 behind the flame port 16. Further, part of the front-end wall is bent inward to form a is spark point 17.

Thus, the piezo electric unit 11 is electrically connected form the spark point 17 through the hollow flexible member 3 to electrode 21 via tubular metal member 13, screw 18, spine 19, and the flame nozzle 14 is connected to the ground electrode 10.

A primary safety switch 8 is mounted within the sliding track with locking and unlocking positions, and part of the primary safety switch traverses the casing 1.

secondary safety switch formed by the push button 24 and rocking lever 22,the push-button 24 is disposed in the sliding track (not shown) at the curved side of the casing 1 and connected to a tension spring 25. The rocking lever 22 is supported to rotate about a pivot 29 and connected to a spring 23 which urged the rocket lever 22 states at locking position.

Trigger 5 is disposed inside at the upper portion of casing 1, wherein part of trigger 5 is exposed to an opening 35 for the pressing of finger, the trigger 5 is constructed with three projections 5A.5B and 5C, projection 5B extend to stop at the top of piezo electric unit 11 and the top of the rocking lever 22 at the locking position projection 5A extend to stop above a gas lever 7 of the inserted disposable gas lighter cartridge 6, projection SC extend to stop at the top of the traverse part of primary safety switch 8 inside the casing 1.

In order to actuate the igniter, trigger S must press down to release the gas from the gas reservoir, jetted to the front pipe 4 and ignite by the electrode discharge of the piezo electric unit 11, with the primary safety switch 8 and rocking lever 22 of secondary safety switch in the locking position, that the engagement of the traverse par of primary safety switch 8 with projection 5C, the engagement of the top part of the rocking lever 22 with projection 5B, trigger 5 is disable to operate, therefore primary safety switch 8 must slide to unlock position, push-button 24 being pushed up to rotate the rocking lever 22 move to unlock position ,then trigger 5 can be pressed down to carry out the ignition, with projection SA pressing the gas lever 7 of the disposable lighter cartridge 6 and projection 5B pressing the piezo electric unit 11 simultaneously the fuel gas is release from the gas reservoir to flame nozzle 14 through the elastic gas flow connector 28, the flexible gas pipe line 9, and the piezo electric unit 11 produces an alternating discharge voltage which is applied between the spark point 17 and tile flame nozzle 14, whereby the fuel gas injected form the flame nozzle 14 is ignited when the trigger 5 and push-button are released, retraction of the piezo electric unit push the trigger 5 back to original position, the rocking lever 22 retreat back automatically to the locking position by the force of spring 23, the push-button retreat back by spring 25, and the fuel supply is cut off when the gas lever 7 is released from the project 5A. From the view point of safety, with the primary and secondary safety switch together, an additional operating procedure is required because when either one of the safety switch is in unlock position, trigger 5 is still disable unless both the primary safety switch and the secondary safety switch are in unlock position at the same time. In addition, the required coordination of the thumb and finger to push the push-button 24 of secondary safety switch and pull the trigger 5 is difficult for children to master thereof inhibit operation by children. Hence, with dual safety switches enable further inhibit operation of the igniter by children.

Figure 2:
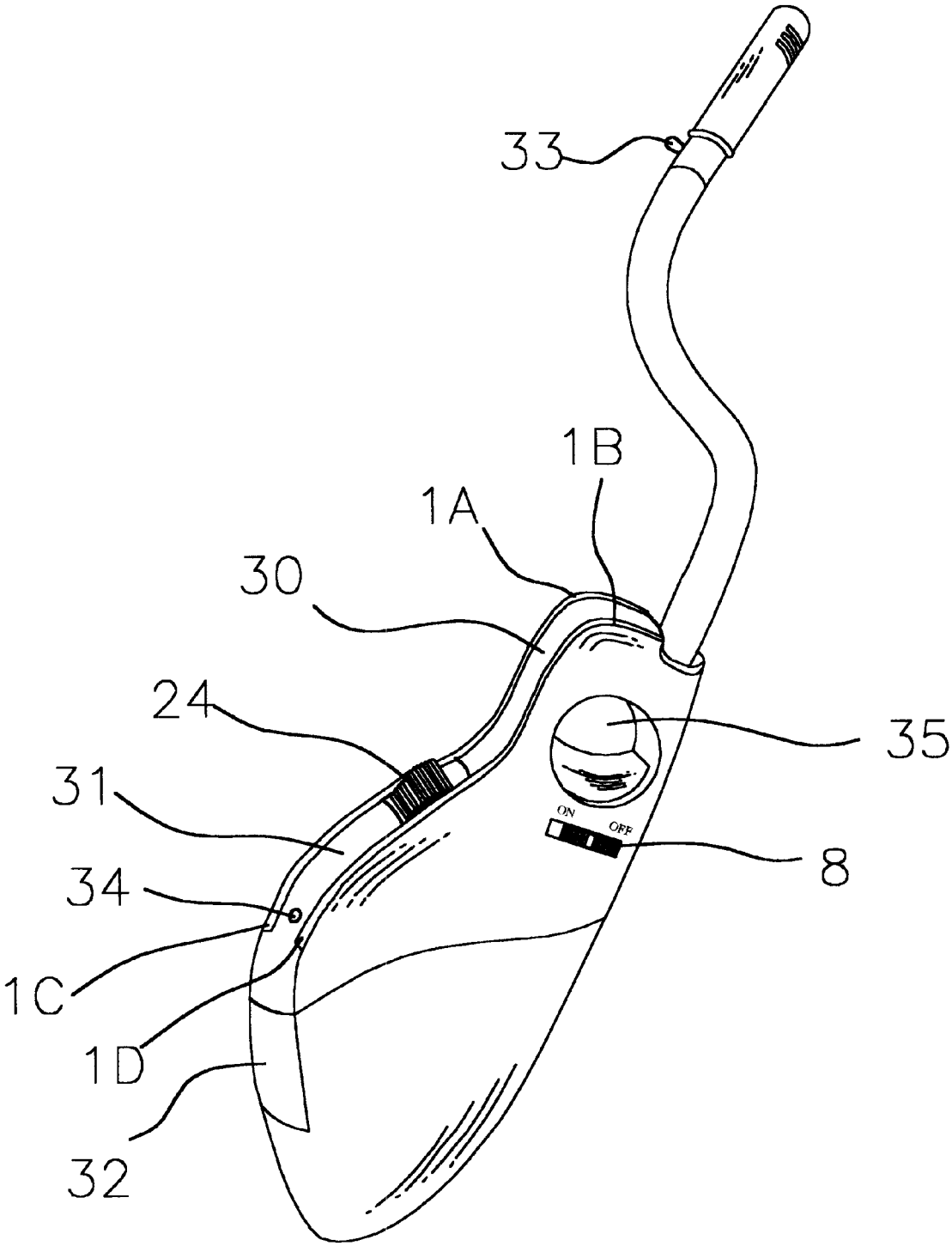
FIG. 2 is a prospect view of the igniter with the flexible member expand

Referring to FIG. 2.The casing 1 constructed with two rolled edges 1A and 1B on the curved side from the top and ended at area 1C and 1D, an elastic member 30 is mounted between the two rolled edges at the top of casing 1, an elastic member 31 constructed with a retaining hole 34 for catching the stud 33 of front pipe 4 is mounted at the lower part of casing 1. Another elastic member 32 is mounted at the container adjacent to elastic member 31. Thus, these three elastic members 30, 31 and 32 mounted on the curved side formed a cushion for the comfort of the user.

Figure 3:
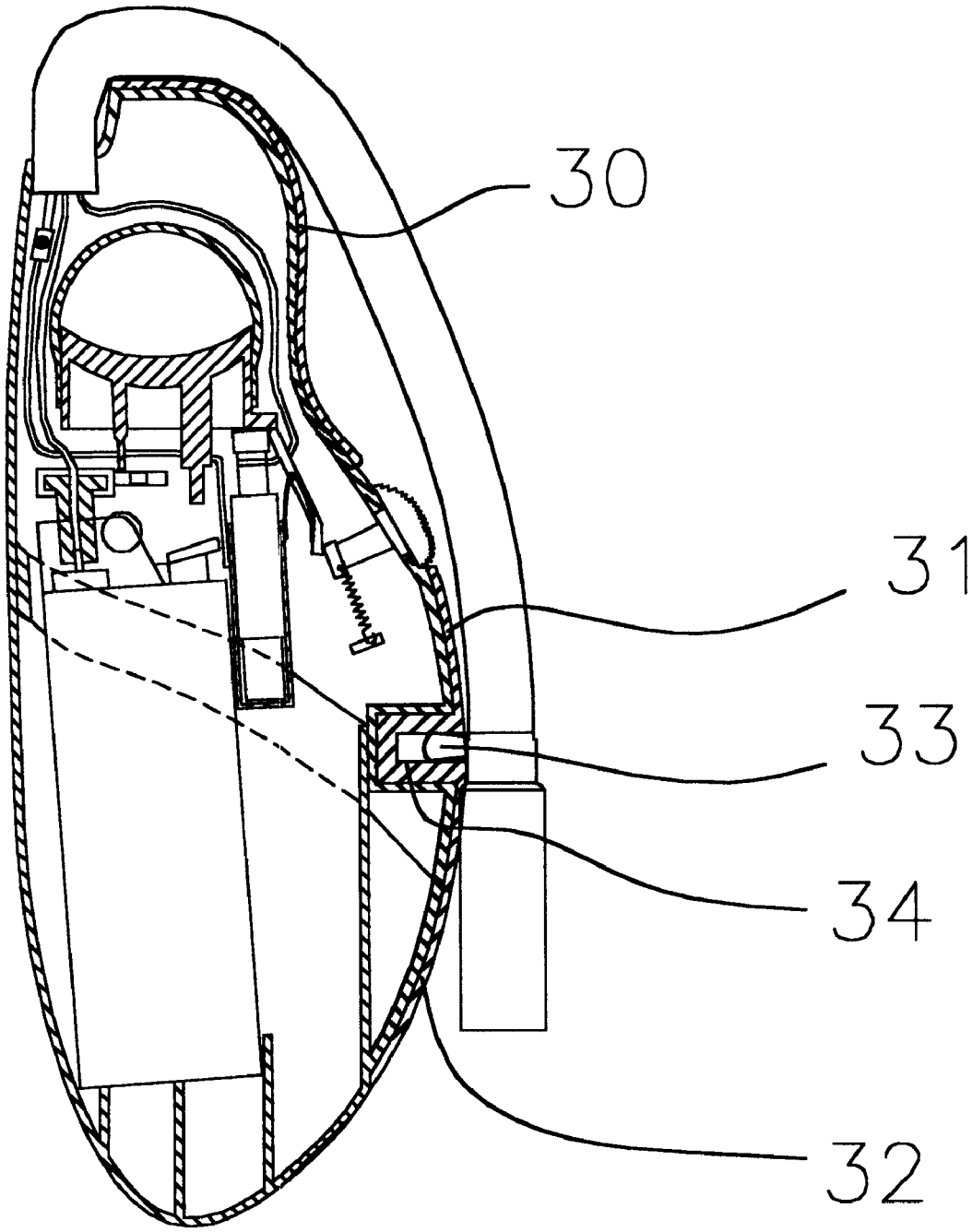
FIG. 3 is a part-sectioned view of the igniter in compact storage position

Referring to FIG. 3., the flexible member 3 whit the stud 33 constructed on front pipe 4 is snapped into the retaining hole 34. At the same time, the flexibility of the elastic member 31 enables the flexible member 3 to be withdrawn from the retaining hole 34 by pulling the front pipe 4 from the casing 1.

A first example of the flexible member 3 is shown in FIG. 1,2 and 3.The flexible member 3 comprises a flexible pipe formed by elastic material, the spine 19 constructed with one or more strands of metal wire is disposed interiorly of the elastic pipe. Thus, the flexible member 3 can be bent freely and retain a given shape.

Figure 5:
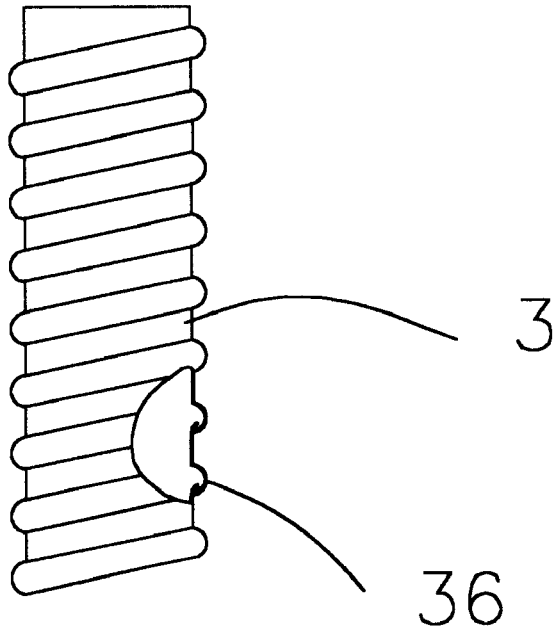
FIG. 5 is a prospect view of a second example of the flexible member
Figure 6:
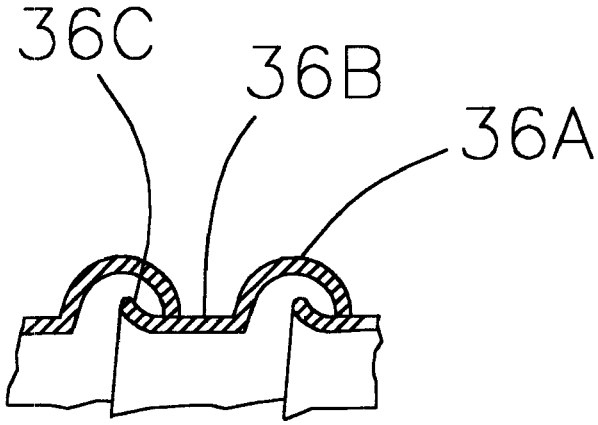
FIG. 6 is a part-sectioned view of the flexible member shown in FIG. 5

A second example of the flexible member 3 is shown in FIG.5 the flexible member 3 found with a plurality of projections in the form of spiral. This flexible member 3 is formed by spirally winding molded molded plate member 36,which consists of long strips of steel molded to a wave shape, so that they closed overlap one another.

The sectional configuration of the molded ribbon plate member 36, as shown in FIG 5. has a curved portion 36A extending outwardly in the form of a semicircle, a flat portion 36B extending axially from the curved portion 36A and a rising potion 36C with its outer end portion curved outwardly. The members 36 are formed into a pipe shape by spirally winding them so that the rising portion 36C is inserted inside the curved portion 36A. Thus, the flexible member 3 can be bent and deformed in a range where the outer end of the rising portion 36C can move within the curve portion 36A. The engagement of the rising portion 36C with the inner surface of the curved portion 36A defines the expandable limit and the bendable limit. Thus, with this, better stability is obtained. Note that on the opposite end portions of the flexible member 3 there maybe formed flat cylindrical connection portions which are inserted and fixed to the casing 1 and inserted by cylindrical nozzle holder 12.

The operation of the gas ignition of this embodiment will be described herein below, this orthopedically engineered ignition fit in the palm of the user very comfortably with the push-button 24 positioned underneath the thumb and the finger through the casing opening 35 to pull the trigger 5. First, slide the primary safety switch 8 to unlock i position, then push the push-button 24 of secondary safety switch with thumb upwardly causing the rocking lever 22 moved to the unlock position, projections 5B and 5C are free to move without the blocking of primary safety switch 8 and rocking lever 22 of 18 secondary safety switch ,when the trigger 5 is depressed, the gas lever 7 of the inserted disposable gas lighter 6 and the piezo electric unit 11 are pressed simultaneously by projections 5A and 5B, the fuel gas is released from the gas reservoir to the flame nozzle 14 by the flexible gas pipe 9, and the piezo electric unit 11 produces an alternating discharge voltage which is applied between the spark point 17 and the flame nozzle 14 whereby the fuel gas injected from the flame nozzle 14 is ignited. When the trigger 5 is released, the rocking lever retreat back to locking position by a spring 23 and the fuel supply is cut off when gas lever 7 is released from projection 5A. When the fuel supply therein is low, the user can easily pull the container 2 apart from casing 1 for refilling with a disposable lighter and simply connect the container 2 back to casing 1 The igniter is then ready for normal use without throw away all the useful parts.

What is claimed is:

1. A gas igniter comprising:

a casing detachably connected to a container, said casing and said container hold an inserted disposable lighter which includes a fuel reservoir and a fuel discharge valve operated by a gas lever which opens said valve in response of depressing of a trigger to release a fuel discharge, said casing having a first partition wall to hold a piezo unit or generating a discharge voltage for lighting said fuel discharge and a second partition wall to hold an elastic gas flow connector connecting the gas flow from said fuel reservoir to a flame nozzle for ignition said trigger which is capable of sliding and which drives said gas lever of said disposable lighter and said piezo unit in order to carry out the ignition, a primary safety switch and a secondary safety switch both having an engagement section, which interfere with a portion of said trigger said safety switches being capable of moving in a direction that interferes with a direction along which said trigger moves, and an urging member, which urges a rocking lever of said secondary safety switch to a locking position, said rocking lever being movable to a lock releasing position against the urging force of said urging member, a flexible member in the form of a hollow pipe extends from one end of the casing and said hollow pipe is connected to a front pipe at an opposite end thereof, a flame nozzle for ignition mounted in said front pipe and a flexible gas pipe connected between said flame nozzle and said fuel reservoir.

2. The gas igniter as set forth in claim 1, wherein said casing is detachable with the said container for the purpose of providing an easy and inexpensive means of gas refilling, whereby a user can refill the igniter with a disposable lighter without discarding all the usable parts.

3. The gas igniter as set forth in claim 1, wherein said flexible member comprises an elastic pipe, a spine constructed by one or more strands of metal wire disposed interiorly of the said elastic pipe that can be easily bent and retained to a given shape, said flexible member connected to a front pipe which constructed with a stud that can snap into a retaining hole of an elastic member for easy storage.

4. The gas igniter as set forth in claim 1, wherein said primary safety switch and said secondary safety switch together provide extra security for the purpose of inhibiting the children to master an ignition that both safety switches must move to unlock position, in order the said trigger can press down to carry out an ignition.

* * * * *